US006334719B1

(12) United States Patent
Kimura

(10) Patent No.: US 6,334,719 B1
(45) Date of Patent: Jan. 1, 2002

(54) STENCIL PRINTER HAVING A POWER SAVING MODE

(75) Inventor: Hitoshi Kimura, Watari-gun (JP)

(73) Assignee: Tohoku Ricoh Co., Ltd, Miyagi (JP)

( * ) Notice: Subject to any disclaimer, the term of this patent is extended or adjusted under 35 U.S.C. 154(b) by 0 days.

(21) Appl. No.: 09/399,956

(22) Filed: Sep. 20, 1999

(30) Foreign Application Priority Data

Oct. 12, 1998 (JP) ..... 10-289178

(51) Int. Cl.[7] ..... B41J 29/38

(52) U.S. Cl. ..... 400/54; 400/74; 365/227; 365/228

(58) Field of Search ..... 101/114, 116, 101/127; 400/54, 70, 74; 713/300, 320, 321, 322, 323, 324, 601; 327/544; 365/226, 227, 228, 229

(56) References Cited

U.S. PATENT DOCUMENTS 4,870,526 A * 9/1989 Maruta et al. ..... 361/1
5,708,821 A * 1/1998 Takikita ..... 395/750
5,897,252 A * 4/1999 Kanakubo ..... 400/74

FOREIGN PATENT DOCUMENTS

| | | |
|---|---|---|
| JP | 5-31141 | 5/1993 |
| JP | 5-124737 | 5/1993 |
| JP | 6-293175 | 10/1994 |
| JP | 7-143746 | 6/1995 |
| JP | 7-186492 | 7/1995 |
| JP | 8 63051 A * | 3/1996 |
| JP | 8-251317 | 9/1996 |
| JP | 10-1254 | 1/1998 |
| JP | 11 221951 A * | 8/1999 |

* cited by examiner

*Primary Examiner*—John S. Hilten
*Assistant Examiner*—Mina H. Chau
(74) *Attorney, Agent, or Firm*—Oblon, Spivak, McClelland, Maier & Neustadt, P.C.

(57) ABSTRACT

A stencil printer for printing an image on a paper or similar recording medium with a master wrapped around its ink drum is disclosed. The stencil printer can be held in a power save mode for saving power when it is not used, and can recover from the power save mode without any wasteful step so as to prevent the first print time from being delayed.

12 Claims, 5 Drawing Sheets

STENCIL PRINTER HAVING A POWER SAVING MODE

BACKGROUND OF THE INVENTION

The present invention relates to a stencil printer capable of printing an image on a paper or similar recording medium with a master wrapped around its ink drum. More particularly, the present invention relates to a stencil printer including a power save mode for saving power when it is not used.

A digital stencil printer is conventional which uses a laminate thermosensitive stencil made up of a thermoplastic resin film and a porous support adhered to each other. The printer includes a thermal head for selectively perforating, or cutting, the resin film of the stencil with heat in accordance image data. After the perforated stencil or master has been wrapped around an ink drum, ink feeding means arranged in the drum feeds an adequate amount of ink to the inner periphery of the drum. A press roller, press drum or similar pressing member presses a paper or similar recording medium against the ink drum so as to transfer the ink from the drum to the paper via the porous portion of the drum and the perforations of the master. As a result, an image represented by the image data is printed on the paper. A modern stencil printer is capable of performing a continuous sequence including master making, used master discharging, paper feeding and printing steps. This, coupled with the increasing resolution and reducing performance cost, has recently motivated users of the kind producing, say, ten or more copies at a time to use the stencil printer in place of a copier.

Now, it is not unusual that a stencil printer or a copier is simply left unused over a long period of time with its power switch turned on, meaning that the actual operation time thereof is short. Even when the printer or the copier is unused, power is wastefully fed to its various drivelines, sensors, and a control panel. To solve this problem, the power switch may be turned off while the printer or the copier is not used. However, a heater for fixing a toner image is essential with the copier. Should power supply to the heater be turned off, it would take several minutes for the heater to be again warmed up to its operative temperature, delaying the first print time.

In light of the above, Japanese Patent Publication No. 5-31141, for example, discloses a copier having a power save mode for saving power when it is not used.

On the other hand, it is a common practice with a stencil printer, which does not need the above heater, to turn off its power switch when the printer is unused. This, however, brings about the following problem to be solved. In a stencil printer capable of continuously performing master making, used master discharging, paper feeding and printing steps, sections for executing such steps include a plurality of sensors for monitoring, e.g., the size of documents and that of papers, the position of the leading edge of a master, the position of an ink drum, and the position of a compresser for compressing a used master removed from the ink drum. It follows that every time the power switch is turned on, various members including the ink drum and compressor must be returned to their home positions all over again, delaying the first print time by about several ten seconds.

A section included in the stencil printer for feeding papers has traditionally been implemented by a fixed size system or a cassette system. Likewise, a section for discharging the paper or printing has conventionally included side fences which are moved by hand in matching relation to a paper size. Japanese Patent Laid-Open Publication No. 5-124737, for example, proposes a paper feeding system capable of sensing the size and the remaining amount of papers and automatically replenishing and feeding the papers. Also, Japanese Patent Laid-Open Publication No. 10-1254, for example, teaches a paper discharging section capable of automatically moving the side fences in matching relation to a paper size. These automatic paper feed and paper discharge schemes, however, aggravate power consumption when the stencil printer is not used.

Further, a personal computer, sorter or similar peripheral unit is often connected to the stencil printer for causing the printer to operate by sending image data via the peripheral unit. In this condition, maintaining the power switch of the printer turned off is not practical, and a configuration for saving power in the stand-by state of the printer is desired.

Technologies relating to the present invention are also disclosed in, e.g., Japanese Patent Laid-Open Publication Nos. 6-293175, 7-143746, 7-186492, and 8-251317.

SUMMARY OF THE INVENTION

It is therefore an object of the present invention to provide a stencil printer having a power save mode for saving power when it is in a stand-by state, and preventing the first printing time from being delayed when it recovers from the power save mode.

In accordance with the present invention, a stencil printer for printing an image on a recording medium with a master wrapped around its ink drum and having a power save mode for saving power when it is not used includes a storing section for storing the conditions of the printer when the power save mode is selected. When the power save mode is selected, a comparing section compares the conditions stored in the storing section and the current conditions of the printer.

Also, in accordance with the present invention, a printing method for causing a stencil printer to print an image on a recording medium with a master wrapped around an ink drum, and including a power save mode for saving power when the printer is not used includes the steps of storing the conditions of the printer when the power save mode is selected, and comparing, when the power save mode is cancelled, the conditions stored and the current conditions of the printer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
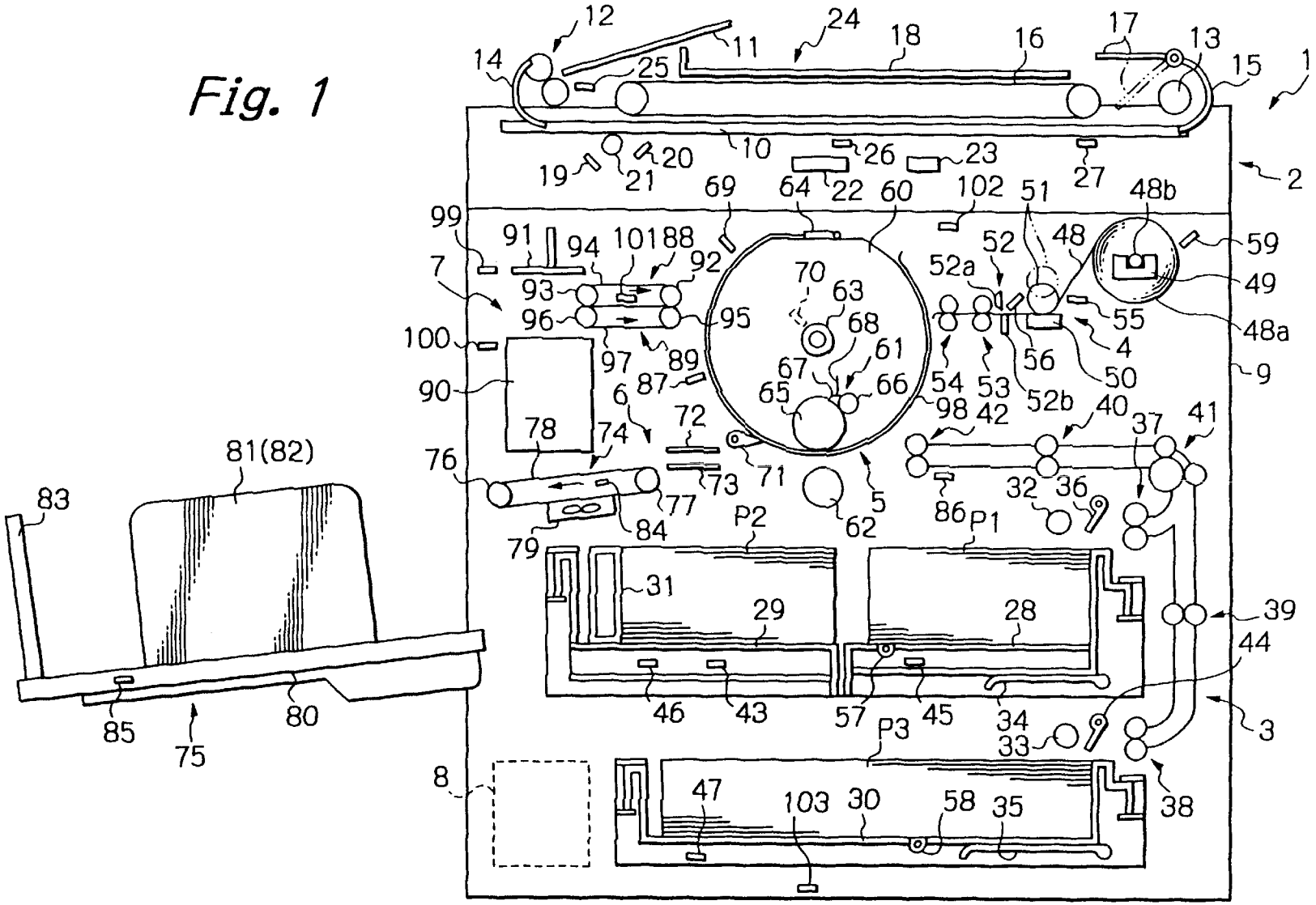
FIG. 1 is a view showing a stencil printer embodying the present invention.

Referring to FIG. 1 of the drawings, a stencil printer embodying the present invention is shown and generally designated by the reference numeral 1. As shown, the stencil printer includes a casing 9 accommodating an image reading section 2, a paper feeding section 3 or multistage paper feeding device 3, a master making section 4, a printing section 5, a paper discharging section 6, a master discharging section 7, and a control section 8.

An image reading section 2 is mounted on the top of the casing 9 and includes a glass platen 10 on which a document is to be laid. A document feed tray 11 is used to lay a desired document or documents. A roller pair 12 and a roller 13 convey a document. Guides 14 and 15 respectively adjoin the roller pair 12 and roller 13 for guiding a document being conveyed. A belt 16 conveys a document along the glass platen 10. A flat direction selector 17 switches a direction in which a document read by the reading section 2 should be discharged. A document discharge tray 18 receives a document driven out via the direction selector 17. Mirrors 19 and 20 and a fluorescent lamp 21 scan a document. A lens 22 focuses the resulting reflection or image light to a CCD (Charge Coupled Device) image sensor or similar image sensor 23.

Among the above constituents of the image reading section 2, the document feed tray 11, roller pair 12, roller 13, guides 14 and 15, belt 16, direction selector 17 and document discharge tray 18 are mounted on a conventional cover plate, not shown, constituting an ADF (Automatic Document Feeder) unit 24. The ADF unit 24 may be angularly moved toward and away from the glass platen 10 by hand. The ADF unit 24 additionally includes a document sensor 25, a document size sensor 26, and a cover plate sensor 27. The document sensor 25 is responsive to a document laid on the document feed tray 11 and the size of the document. The document size sensor 26 is responsive to the size of a document laid on the glass platen 10. The cover plate sensor 27 is responsive to the absence of the ADF unit 24 (cover plate not shown) on the glass platen 10.

The paper feeding section 3 arranged in the lower portion of the casing 9 has a configuration taught in Japanese Patent Laid-Open Publication No. 5-124737 mentioned earlier. Specifically, the paper feeding section 3 includes a first tray 28, a second tray 29, and a third tray 30 each constituting a paper stocking portion. The first and second trays 28 and 29 allow papers P1 and P2 of the same size to be stacked thereon. The third tray 30 allows papers P3 of relatively large size to be stacked thereon. A paper shifter 31 shifts the entire paper stack P2 from the tray 29 to the tray 28 when the papers P1 on the tray 28 are used up. Pick-up rollers 32 and 33 respectively feed the papers P1 and P3 one by one. Pressers 34 and 35 press the papers P1 and P3 against the pick-up rollers 32 and 33, respectively. A first paper sensor 36 senses the papers P1 stacked on the first tray 28 when contacting the papers P1 pushed up by the presser 34. Separation roller pairs 39 and 40 are respectively associated with the pick-up rollers 32 and 33, and each separates the top paper from the underlying papers. Additionally included in the paper feeding section 3 are roller pairs 39 and 40 and a group of rollers 41 for conveyance, and a registration roller pair 42. The second tray 29 may be pulled out of the casing 9 while the printer 1 is in operation, as desired. A pair of side fences, not shown, are mounted on each of the trays 28–30 for guiding the papers P1–P3 in the widthwise direction of the papers.

In the paper feeding section 3, a second paper sensor 43 senses the papers P2 stacked on the second tray 29 while a third paper sensor 44 senses the papers P3 stacked on the third tray 30. A first paper size sensor 45, a second paper size sensor 46 and a third paper size sensor 47 are used to determine the sizes of the papers P1, P2 and P3, respectively. A first residual paper sensor 57 determines the amount of papers P1 remaining on the first tray 28 in terms of the amount of elevation of the tray 28 caused by the presser 34. Likewise, a third residual paper sensor 58 determines the amount of papers P3 remaining on the third tray 30 in terms of the amount of elevation of the tray 30 caused by the presser 35. A jam sensor 86 determines that a jam has occurred when any one of the papers P1–P3 fails to reach the registration roller pair 42 within a preselected period of time.

The master making section 4 arranged above the paper feeding section 3 includes a support member 49 supporting a stencil 48 in the form of a roll 48*a*. A thermal head 50 perforates, or cuts, the stencil 48 by heating it. A platen roller 51 presses the stencil 48 against the thermal head 50 while conveying the stencil 48. Cutting means 52 cuts the stencil 48 at a preselected length. Roller pairs 53 and 54 convey the stencil 48. The master making section 4 is constructed into a unit removable from the casing 9.

Specifically, the stencil roll 48*a* includes a core 48*b* rotatably supported by the support member 49. A stepping motor, not shown, causes the platen roller 51 to rotate while moving means, not shown, selectively moves the platen roller 51 to a first position indicated by a solid line in FIG. 1 or a second position indicated by a dash-and-dots line. At the first position, the platen roller 51 is pressed against the thermal head 50 by a preselected pressure. At the second position, the platen roller 51 is spaced from the thermal head 50. The cutting means 52 has a conventional configuration in which an upper edge 52*a* is rotatable or movable up and down relative to a lower edge 52*b*.

The master making section 4 additionally includes a stencil roll sensor 59 responsive to the stencil roll 48*a*, a platen roller sensor 55 responsive to the platen roller 51 brought to the pressing position, and a leading edge sensor 56 responsive to the leading edge of the stencil 48 brought to an initial position to be cut by the cutting means 52.

The printing section 5 is arranged at the left of the master making section 4, as viewed in FIG. 1. The printing section 5 includes an ink drum 60, ink feeding means 61, and a press roller 62. The ink drum 60 is made up of a hollow cylindrical, porous support member and a laminate of mesh screens covering the outer periphery of the support member and formed of resin or metal. The ink drum 60 is affixed to flanges, not shown, rotatably mounted on a shaft 63 which plays the role of an ink feed pipe at the same time. Drum drive means, not shown, causes the ink drum 60 to rotate in synchronism with the registration roller pair 42. The ink drum 60 is removably mounted on the casing 9. A damper 64 is mounted on the outer periphery of the ink drum 60 for clamping the leading edge of the perforated part of the stencil 48 (master 48 hereinafter). Opening/closing means, not shown, causes the damper 64 to open and then close when the ink drum 60 reaches a preselected angular position.

The ink feeding means 61 disposed in the ink drum 60 includes an ink roller 65 and a doctor roller 66 in addition to the shaft 63. The ink droller is rotatably supported by side plates, not shown, affixed to the shaft 63. Drive transmitting means, not shown, including gears and a belt transfers a driving force to the ink roller 65 and causes it to rotate clockwise, as viewed in FIG. 1. The doctor roller 66 adjoins the ink roller 65 such that the outer periphery of the roller 66 is parallel to the outer periphery of the roller 65. The ink roller 65 and doctor roller 66 form a generally wedge-shaped ink well 67 therebetween. Ink in the ink well 67 is drawn out while passing through a gap between the two rollers 65 and 66, forming a thin film on the roller 65. An ink sensor 68 is positioned in the ink well 67 for determining the amount of ink existing in the ink well 67.

The press roller 62 is positioned beneath the ink drum 60 and supported by opposite side walls, not shown, of the casing 9 in such a manner as to be rotatable and angularly movable. A cam, for example, causes the press roller 62 to angularly move into and out of contact with the ink drum 60, although not shown specifically. A spring or similar biasing means, not shown, constantly biases the press roller 62 toward the ink drum 60. When the press roller 62 is moved away from the ink drum 60, locking means, not shown, locks the roller 62 in a spaced position shown in FIG. 1.

The printing section 5 additionally includes an right-and-left image position adjusting mechanism (see Japanese Patent Laid-Open Publication No. 6-293175 mentioned earlier) and a top-and-bottom image position shifting mechanism. The right-and-left image position adjusting mechanism shifts the ink drum 60 in the axial direction of the shaft 63 for shifting the image of a document to be printed on a paper fed from the paper feeding section 3 in the widthwise direction of the paper. The top-and-bottom image position shifting mechanism moves the ink drum 60 in its circumferential direction so as to bring the drum 60 out of synchronism with the registration roller pair 42, thereby shifting the position of an image to be printed on a paper in the direction of paper conveyance. Two drum sensors 69 and 70 are arranged around the ink drum 60. The drum sensor 69 is responsive to the axial position of the ink drum 60 while the drum sensor 70 is responsive to the circumferential position of the same and includes, e.g., an encoder. The drum sensors 69 and 70 each sense the displacement of the ink drum 60 from a particular home position. A master absence sensor 87 is responsive to the absence of the master 48 on the outer periphery of the ink drum 60.

The paper discharging section 6 arranged at the left of the printing section 5, as viewed in FIG. 1, includes a peeler 71, guides 72 and 73, a conveyor 74, and an electrically driven rack 75. The peeler 71 peels off the paper or printing P (any one of the papers P1–P3) wrapped around the ink drum 60. The peeler 71 is pivotally supported by the sidewalls, not shown, of the casing 9 such that the edge thereof is movable toward and away from the ink drum 60. The guides 72 and 73 are affixed to the sidewalls of the casing 9 for guiding the printing P separated from the ink drum 60 by the peeler 71. The conveyor 74 is made up of a drive roller 76, a driven roller 77, an endless belt 78 passed over the two rollers 76 and 77, and a suction fan 79. While the suction fan 79 sucks the printing P onto the belt 78, the belt 78 is driven by the drive roller 76 to convey the paper P in the direction indicated by an arrow in FIG. 1.

The paper P conveyed by the conveyor 74 is discharged to the electrically driven rack 75. The rack 75 includes a tray 80 to be loaded with the papers or printings P, a pair of side fences 81 and 82, and an end fence 83. The rack 75 locates each of the side fences 81 and 82 and end fence 83 at a particular position in accordance with a paper size signal output from the paper feeding section 3.

The paper discharging section 6 includes a paper jam sensor 84 responsive to a paper jam and a fence sensor 85 responsive to the positions of the side fences 81 and 82 and end fence 83. The paper jam sensor 84 determines that a jam has occurred when the paper P has failed to reach the conveyor 74 within a preselected period of time.

The master discharging section 7 is located above the paper discharging section 6 and includes an upper discharge member 88, a lower discharge member 89, a box 90 for collecting used masters, and a compressor 91. The upper discharge member 88 is made up of a drive roller 92, a driven roller 93, and an endless belt 94 passed over the two rollers 92 and 93. The drive roller 92 rotates clockwise, as viewed in FIG. 1, causing the belt 94 to move in the direction indicated by an arrow. Likewise, the lower discharge member 89 is made up of a drive roller 95, a driven roller 96, and an endless belt 97 passed over the rollers 95 and 96. The drive roller 95 rotates counterclockwise, as viewed in FIG. 1 to move the belt 97 in the direction indicated by an arrow. Moving means, not shown, selectively moves the lower discharge member 89 to a position shown in FIG. 1 or a position where the circumference of the drive roller 95 contacts a used master 98 wrapped around the ink drum 60. Lowering means, not shown, selectively lowers the compressor 91 into the box 90 for compressing the used master 98 collected in the box 90. The two discharge members 88 and 89, box 90 and compressor 91 are constructed into a unit removable from the casing 9.

The master discharging section 7 additionally includes a compressor home position sensor 99 responsive to the home position of the compressor 91, a full sensor 100 responsive to the full state of the box 90, and a jam sensor 101 responsive to a jam of the used master 98. The box 90 is determined to be full when the compressor 91 does not move downward when applied with a preselected torque.

Further, a body door sensor 102 and a paper feed door sensor 103 are mounted on the casing 9. The body door sensor 102 is responsive to the opening of a body door, not shown, which is opened and closed at the time of replacement and the initial setting of the stencil roll 48*a*, mounting and dismounting of the ink drum 60, mounting and dismounting of the box 90, etc. The paper feed door sensor 103 is responsive to the opening of a paper feed door, not shown, which is opened and closed at the time of replenishment of the papers P.

Figure 2:
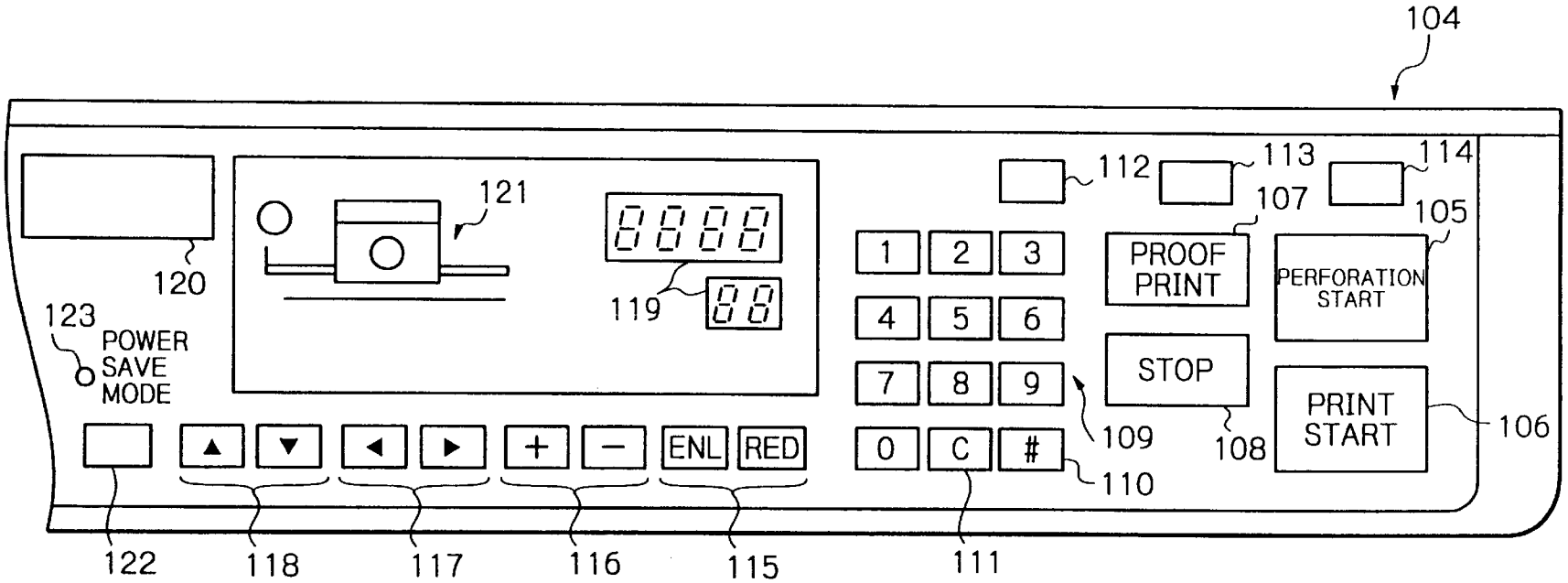
FIG. 2 is a plan view showing a specific configuration of a control panel included in the illustrative embodiment.

FIG. 2 shows a specific arrangement of a control panel 104 mounted on the front part of the top of the stencil printer 1. As shown, the control panel 104 includes a perforation start key 105 for starting a master making operation, a print start key 106, a proof print key 107, a stop key 108, numeral keys 109, an enter key 110, a clear key 111, a program key 112, a mode key 113, a mode clear key 114, enlarge/reduce keys 115, print speed keys 116, right-and-left image position keys 117, top-and-bottom image position keys 118, a display 119 implemented by seven-segment LEDs (Light Emitting Diodes), an error display 120 for displaying, e.g., a jam and implemented by LEDs, and a display 121 implemented by an LCD (Liquid Crystal Display). Also arranged on the control panel 104 are a power save mode key 122 and power save mode indicating means 123 indicative of a power save mode selected on the key 122 and implemented by an LED. Operation commands input on the control panel 104 are sent to the control section 8, FIG. 1. The control section 8, in turn, sends display signals to the displays 119, 120 and 121 and power save mode indicating means 123.

Figure 3:
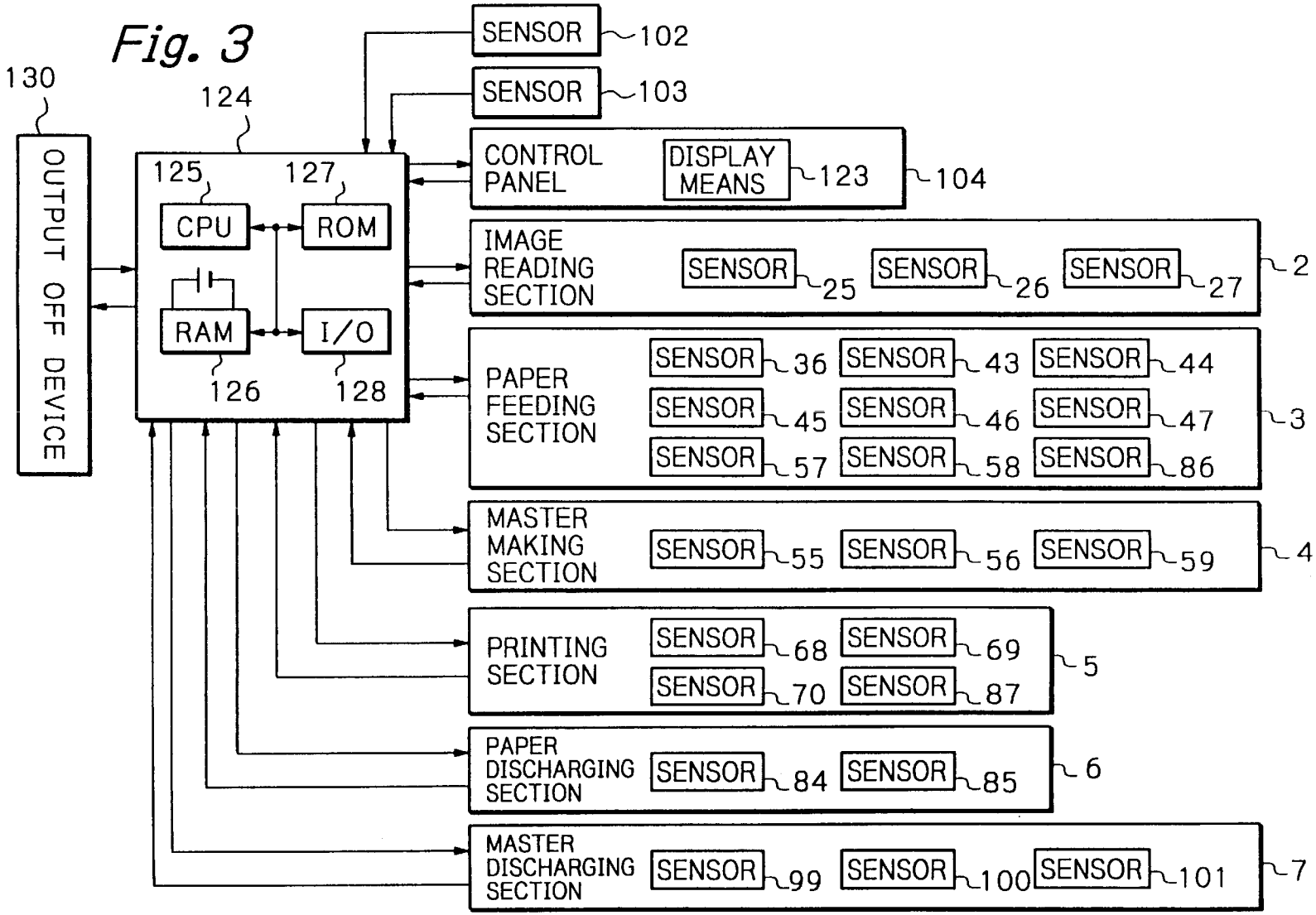
FIG. 3 is a block diagram schematically showing a control system also included in the illustrative embodiment.
Figure 4:
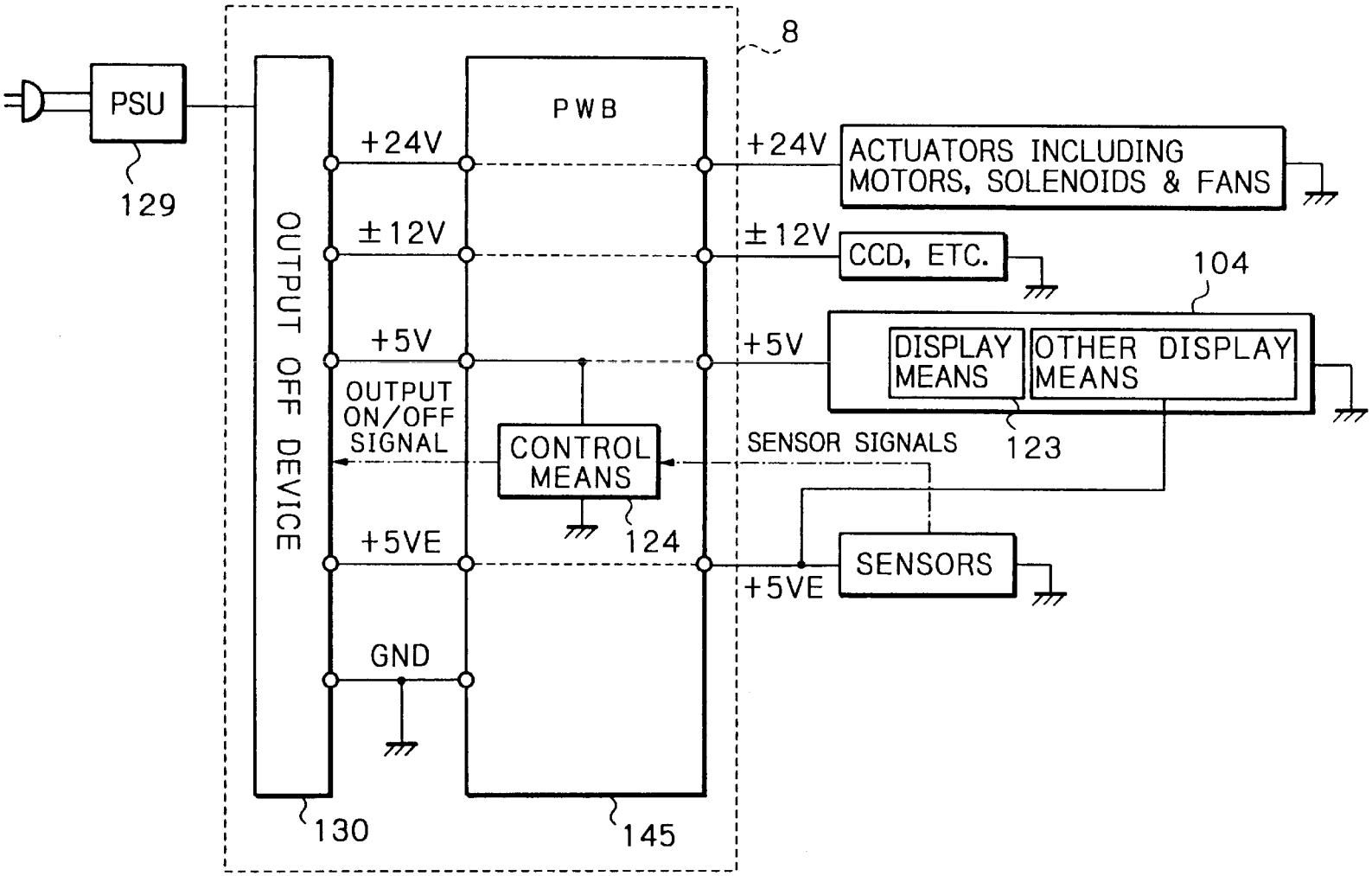
FIG. 4 is a schematic block diagram showing electric circuitry of the illustrative embodiment more specifically.

FIG. 3 shows control means 124, an output OFF device 130 and a PWB (Printed Wiring Board) 145 (see FIG. 4) constituting the major part of the control section 8, FIG. 1. As shown, the control means 124 is implemented by a conventional microcomputer including a CPU (Central Processing Unit) 125, a RAM (Random Access Memory) 126, a ROM (Read Only Memory) 127, and an I/O (Input/Output) expander 128. The control means 124 is mounted on the PWB 145 disposed in the control section 8. As shown in FIG. 4, the control means 124 controls the entire printer 1 with power fed from a PSU (Power Supply Unit) 129 via the output OFF device 130.

The CPU 125 receives the output signals of the various sensors and control panel 104. The image reading section 2, paper feeding section 3, master making section 4, printing section 5, paper discharging section 6 and master discharging section 7 each are connected to the CPU 125 via a respective driver. The CPU 125 performs, based on a program stored in the ROM 127 beforehand, operations with the signals input from the sensors and control panel 104 and sends a particular control signal to the driver of each of the above sections 2–7. At the same time, the CPU 125 sends display signals to the control panel 104.

The CPU 125 temporarily writes the program read out of the ROM 127 in the RAM 126. The program written to the RAM 126 may be rewritten via the control panel 104, as needed. Further, only when the operator selects the power save mode on the power save mode key 122, a power save mode program is written to the RAM 126. A back-up battery is associated with the RAM 126 so as to hold the programs written to the RAM 126 even when the main power supply of the printer 1 is turned off.

The ROM 127 stores a plurality of different programs for operating various actuators included in the printer 1. Particularly, when the operator selects the power save mode on the key 122, the power save mode program causes the positions of various portions determined by the displacements of the actuators to be written to the RAM 126 and causes the output OFF device 130 to turn off the outputs of various sections.

As shown in FIG. 4, the PWB 145 includes a plurality of connection terminals. Power output from the PSU 129 is input to the PWB 145 via the output OFF device 130 in the form of four different voltages of +24 V, ±12 V, +5 V and +5 VE. The voltage of +24 V drives motors, solenoids and fans included in the printer 1 as actuators while the voltage of ±12 V drives, e.g., the image sensor 23 of the image reading section 2. The voltage of +5 V is applied to the control means 124 and the power save mode indicating means 123 of the control panel 104. Further, the voltage of +5 VE is applied to the sensors of the printer 1 and the display means of the control panel 104 other than the power save mode indicating means 123.

The output OFF device 130 is connected between the PSU 129 and the PWB 145 and includes a switching circuit implemented by, e.g., FETs (Field Effect Transistors). The output OFF device 130 selectively sets up or interrupts the supply of +24 V, ±12 V and 5 VE in accordance with an output ON/OFF signal fed from the control means 124.

The printer 1 having the above construction will be operated as follows. When the main power supply of the printer 1 is turned on, the control means 124 causes the ink drum 60 to move axially to its axial home position. The drum axial position sensor 69 senses the drum ink 60 reached the axial home position and then sends its output to the control means 124. In response, the control means 124 causes the ink drum 60 to move circumferentially to its circumferential home position. The drum circumferential position sensor 70 senses the ink drum 60 reached the circumferential home position and sends its output to the control means 124. As a result, the ink drum 60 is held at a preselected master feed position. Ink is fed to the ink well 67 within the ink drum 60 until the ink sensor 68 senses the ink.

At the same time, the control means 124 causes the compressor 91 to be lowered past the full sensor 100 and then located at a home position to which the compressor home position sensor 99 is responsive. If the compressor 91 cannot be lowered past the full sensor 100, a suitable message representative of the full condition of the box 90 appears on the control panel 104.

Further, the control means 124 causes the pressers 34 and 35 of the paper feeding section 3 to be raised until the paper stacks P1 and P3 contact the pick-up rollers 32 and 33, respectively. At this instant, the presence/absence of each paper stack P and the remaining amount of the same are determined. Specifically, if the paper stack P3 is absent, the presser member 35 is returned to its initial position shown in FIG. 1 while the absence of the paper stack P3 is displayed on the control panel 104. Likewise, if the paper stacks P1 and P2 are absent, the presser 34 is returned to its initial position while the absence of the paper stacks P1 and P2 is displayed on the control panel 104. Assume that the paper stack P1 is absent, but the paper stack P2 is present. Then, after the return of the presser 34 to the initial position, the paper shifter 31 shifts the entire paper stack P2 to the first tray 28 while a message representative of the absence of the stack P2 appears on the control panel 104.

In parallel with the above operation of the paper feeding section 3, the paper discharging section 6 locates the side fences 81 and 82 of the rack 75 at their home positions and then move them to positions matching with the size of the papers P sensed by any one of the paper size sensors 45–47. The side fences 81 and 82 are accurately located on the basis of the output of a fence sensor 85. At the same time, the suction fan 79 is caused start operating.

In the master making section 4, the stencil roll sensor 59 determines whether or not the stencil roll 48*a* is present, while the platen roller sensor 55 determines whether or not the platen roller 51 and thermal head 50 are held in contact with each other. If the stencil roll 48*a* is absent, a message representative of the absence appears on the control panel 104. Likewise, if the platen roller 51 is not in contact with the thermal head 50, a message representative of such an erroneous position of the roller 51 appears on the control panel 104. If the sensors 59 and 55 both turn on, but the leading edge sensor 56 does not turn on, the platen roller 51 is driven to convey the stencil 48 until the sensor 56 turns on.

Further, if one or more of the cover plate sensor 27, paper discharge jam sensor 84, paper feed jam sensor 86, master discharge jam sensor 101, body door sensor 102 and paper feed door sensor 103 remain in an ON state, a message representative of such a condition appears on the control panel 104.

As stated above, the printer 1 is ready to make a master (stand-by state) only if the ink drum 60 is located at its axial and circumferential home positions, if the ink sensor 68 senses the ink in the ink well 67, if the compressor 91 is located at its home position with the empty box 90, if the paper feeding section 3 is loaded with papers to use, if the stencil roll 48*a* is set on the support member 49, if the platen roller 51 is in contact with the thermal head 50 with the leading edge sensor 56 sensing the leading edge of the stencil 48, and if all the sensors 27, 84, 86, 101, 102 and 103 are in an OFF state.

Assume that the operator lays one or more documents on the document feed tray 11, sets desired master making conditions on the various keys of the control panel 104, and then presses the perforation start key 105. In response, the image reading section 2 reads the document brought to the glass platen 10 while sending an image data signal representative of the document to the control means 124.

In parallel with the operation of the image reading section 2, the master discharging section 7 removes the used master 98 from the ink drum 60. Specifically, drum drive means, not shown, causes the ink drum 60 with the used master 98 wrapped therearound to rotate counterclockwise, as viewed in FIG. 1. When the control means 124 determines that the trailing edge of the used master 98 has reached a preselected discharge position corresponding to the drive roller 95, the control means 124 causes the drive means and moving means to rotate the drive rollers 92 and 95 and move the lower discharge member 89 toward the ink drum 60. At the time when the drive roller 95 contacts the used master 98, the ink drum 60 is rotating counterclockwise. Therefore, the used master 98 picked up by the drive roller 95 is nipped by the upper discharge roller 88 and lower discharge roller 89 and peeled off from the drum 60 thereby. Thereafter, the used master 98 is conveyed to the box 90 by the discharge members 89 and 88 and compressed in the box 90 by the compressor 91.

After the used master 98 has been fully removed from the ink drum 60, the ink drum 60 is further rotated to the previously mentioned master feed position. Subsequently, the control means 124 causes the opening/closing means to open the damper 64. In this condition, the ink drum 60 waits for a new master. This is the end of the master discharging operation.

The above master discharging operation is followed by a master making operation. Specifically, after the ink drum 60 has been brought to the master feed position, the control means 124 causes the stepping motor to rotate the platen roller 51 and roller pairs 53 and 54 with the result that the stencil 48 is paid out from the roll 48*a*. The thermal head 50 selectively perforates the stencil 48 with heat in accordance with the image data output from the image reading section 2.

The perforated part of the stencil, i.e., the master 48 is conveyed toward the damper 64. When the control means 124 determines that the leading edge of the master 48 has reached a preselected position to be clamped by the damper 64 in terms of the number of steps of the stepping motor, it cause the opening/closing means to close the damper 64. As a result, the leading edge of the master 48 is retained on the ink drum 60.

Subsequently, the ink drum 60 is caused to rotate clockwise at a peripheral speed equal to the speed at which the master 48 is conveyed, sequentially wrapping the master 48 therearound. When the control means 124 determines that a single master 48 has been completed, it causes the platen roller 51 and roller pairs 53 and 54 to stop rotating and causes the upper edge 52*a* of the cutting means 52 to move and cut off the master 48. The master 48 pulled out by the ink drum 60 in rotation is fully wrapped around the drum 60 when the drum 60 again reaches its home position. The ink drum 60 is caused to stop rotating on reaching the home position.

After the master 48 has been wrapped around the ink drum 60, a trial printing step is executed. After the ink drum 60 has been stopped at the home position, the control means 124 causes the drum 60 to start rotating at a low speed and causes the pick-up roller 32 (or 33), separation roller pair 37 (or 38) and roller pairs 39–41 to start rotating. The pick-up roller 32 (or 33) and separation roller pair 37 (or 38) cooperate to pull out the top paper P from the first tray 28 (or third tray 30). The registration roller pair 42 nips the leading edge of the paper P fed from the tray 28 (or 30).

When the leading edge of the image area of the master 48 wrapped around the ink drum 60 reaches a position corresponding to the press roller 62, the control means 124 causes the registration roller pair 42 to start rotating and driving the paper P toward the gap between the ink drum 60 and the press roller 62. The control means 124 actuated the registration roller pair 42, as stated above, causes the locking means to unlock the press roller 62. As a result, the press roller 62 is angularly moved toward the ink drum 60.

The press roller 62 presses the paper P fed from the registration roller pair 42 against the master 48 existing on the ink drum 60. Consequently, the paper P and master 48 are pressed between the press roller 62 and the ink drum 60. Ink fed to the inner periphery of the ink drum 60 by the ink roller 65 penetrates through the porous support and mesh screens of the ink drum 60 and then fills the interstice between the ink drum 60 and the master 48. Finally, the ink is transferred from the ink drum 60 to the paper P via the perforations of the master 48.

The peeler 71 peels off the paper P carrying the ink thereon from the ink drum 60 while introducing it into the gap between the guides 72 and 73. The paper P is conveyed to the left, as viewed in FIG. 1, by the belt 78 while being held on the belt 78 by the suction of the suction fan 79. As a result, the paper or trial printing P is driven out to the tray 80. Thereafter, the printer 1 waits for an actual printing operation.

In the above condition, the operator presses the proof print key 107. In response, another paper P is fed from the paper feeding section 3 and nipped by the registration roller pair 42 in the same manner as the first paper P. At the same time, the ink drum 60 is caused to rotate at a high speed at the same timing as in the trial printing procedure. The registration roller pair 42 drives the paper P toward the gap between the ink drum 60 and the press roller 62. The paper P is pressed against the master 48 present on the ink drum 60 by the press roller 62 with the result that the ink is transferred to the paper P for forming an image. The peeler 71 removes the paper P from the ink drum 60, and the conveyor 74 conveys the paper P to the tray 80. As soon as the ink drum 60 is returned to the circumferential home position, the proof printing procedure ends.

The operator watching the proof printing determines whether or not it is acceptable. If the proof printing P is not acceptable, the operator readjusts the image by operating the print speed key 116, right-left image position key 117 and top-bottom image position key 118 and produces another proof printing. If the resulting proof printing is acceptable, the operator inputs a desired number of printings on the numeral keys 109 and then presses the print start key 106. The number of printings input on the numeral keys 109 appears on the display 119. The paper feeding section 3 continuously feeds the same number of papers P as the desired number of printings. While the ink drum 60 again returns to its home position after the printing operation, this home position includes the shift in the right-and-left direction and the shift in the top-and-bottom direction.

The printer 1 performs the following operation when the power save mode key 122 unique to the illustrative embodiment is pressed. Assume that the operator completed the above printing operation with the printer 1 will not use it for more than a preselected period of time. Then, the operator presses the power save mode key 122. In response to the resulting signal output from the control panel 104, the CPU 125 calls the power save mode program stored in the ROM 127, writes data in the RAM 126, and sends a signal to the control panel 104 to turn on the power save mode indicating means or LED 123. This allows the operator to confirm the power save mode. In the power save mode, the RAM 126 plays the role of printer status storing means.

The above data written to the RAM 126 include the outputs of the paper sensors 36, 43 and 44, the outputs of the paper size sensors 45–47, the outputs of the residual paper sensors 57 and 58, the output of the platen roller sensor 55, the output of the leading edge sensor 56, the output of the stencil roll sensor 59, the output of the ink sensor 68, the output of the drum axial position sensor 69, the output of the drum circumferential position sensor 70, the output of the fence sensor 85, and the output of the full sensor 100.

Further, the CPU 125 sends an output OFF signal to the output OFF device 130 in order to interrupt the supply of the voltages other than the voltage of +5 V. As a result, all the outputs other than the output of the power save mode indicating means 123 are turned off, i.e., power supply to the circuitry other than the power save mode indicating means 123 is interrupted in order to save power.

When the operator selected the power save mode again presses the power save mode key 122, the CPU 125 sends, in response to the resulting signal from the control panel 104, an output ON signal to the output OFF device 130. In response, the output OFF device 130 again sets up the supply of the voltages of +24 V, ±12 V and +5 VE and thereby turns on all of the outputs of the printer 1, so that the power save mode is cancelled. At this instant, the CPU 125 reads the data stored in the RAM 126 at the beginning of the power save mode operation and compares them with current data. In this sense, the CPU 125 serves as comparing means at the time of recovery from the power save mode.

If the stored data and current data compare equal, the printer 1 is immediately brought to its stand-by state, skipping the steps to be executed at the time of the turn-on of the main power supply. If any one of the current data differs from corresponding one of the stored data, the printer 1 is brought to the stand-by state after causing only a portion relating to the different data to operate or after varying the display. It should be noted that the printer 1 neglects the above difference if it is derived from a change in the status of the full sensor 100 from ON (at the beginning of the power save mode) to OFF (at the time of cancellation of the power save mode).

As stated above, when the printer 1 is not used, the power save mode is set up to obviate wasteful power consumption. In addition, at the time of cancellation of the power save mode, the printer 1 skips needless steps in order to prevent the first print time from being delayed.

The illustrative embodiment may be modified as follows. In a first modification, in the power save mode, power is fed to the entire control panel 104, i.e., the voltage of +5 V is continuously applied not only to the power save mode indicating means 123 but also to the other constituents; the power save mode is cancelled when the operator presses any one of the keys on the control panel 104. In a second modification, in the power save mode, power supply to the body door sensor 102 and paper feed door sensor 103 is not interrupted; the power save mode is cancelled when the operator opens the body door or the paper feed door. In a third modification, in the power save mode, power supply to the document sensor 25 and cover plate sensor 27 is not interrupted; the power save mode is cancelled when the operator lays a document or documents on the document feed tray 11 or opens the ADF unit 24 away from the glass platen 10. In a fourth modification, in the power save mode, power supply to the paper sensors 36 and 44 is not interrupted; the power save mode is cancelled when the status relating to the papers P changes from "absence" to "presence". In a fifth modification, a human body sensor, not shown, is positioned in the upper portion of the casing 9, so that the power save mode is cancelled when the sensor senses a human body. In a sixth modification, a sensor, not shown, is located in the vicinity of the master making section 4; the power save mode is cancelled when the master making section 4 is pulled out of the casing 9. In a seventh modification, a sensor, not shown, is located in the vicinity of the ink drum 60; the power save mode is cancelled when the ink drum 60 is pulled out of the casing 9. In an eighth modification, a sensor, not shown, is located in the vicinity of the box 90; the power save mode is cancelled when the box 90 is pulled out of the casing 9.

The power save mode operation may begin on the elapse of a preselected period of time since the operator has pressed the power save mode key 122 or since the printer 1 has been operated last time.

An arrangement may be made such that the power save mode is inhibited when any one of the jam sensors 84, 86 and 101 and leading edge sensor 56 senses a jam or when a serviceman call occurs (indicated by the display 120 of the control panel 104), thereby promoting rapid jam processing or repair. This is also true when the master absence sensor 87 does not sense the master 48 expected to be present on the ink drum 60; the master 48 is not present on the drum 60 at the time of delivery to the user's station or is removed from the drum 60 at the time of a jam. The sensor 87 therefore prevents the ink from being evaporated from the surface of the ink drum 60 and rendering printings to be produced later defective. Further, the power save mode may be inhibited during master making operation, master discharging operation, printing operation and so forth; otherwise, the printer 1 would stop operating halfway and would need a substantial period of time for recovery.

Figure 5:
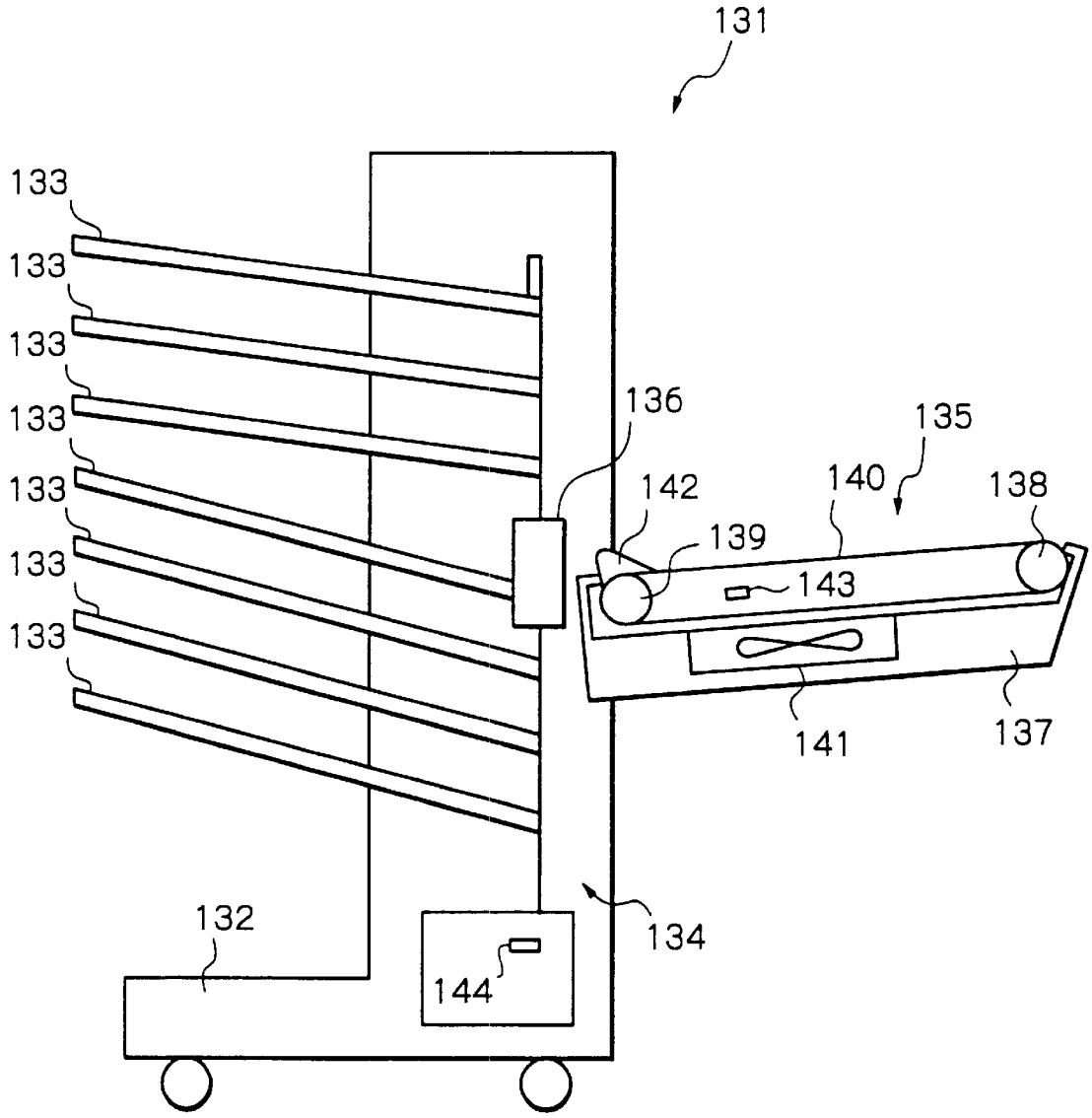
FIG. 5 is a view showing a sorter or peripheral unit applicable to an alternative embodiment of the present invention.

Referring to FIG. 5, a sorter, or peripheral unit, with which an alternative embodiment of the present invention is practicable is shown. As shown, the sorter, labeled 131, is connected to the printer 1 in place of the electrically driven rack 75. The sorter 131 includes a sorter body 132, bins 133 movable up and down, a mechanism 134 for moving the bins 133 up and down, and a conveyor 135 for conveying the papers P sequentially driven out of the printer 1 toward the bins 133. The operation of the sorter 131 is dependent on the power supply of the printer 1.

Each bin 133 is bent substantially vertically upward at its upstream end in the direction of paper conveyance. A roller, not shown, is mounted on the underside of each bin 133. The lowermost bin 133 is affixed to a bracket, not shown, included in the mechanism 134. The uppermost bin 133 has its bent end extended more than the other bins 133 and serves as a non-sort tray.

The mechanism 134 includes a lead cam 136 having a spiral groove in its circumference and drive means, not shown, in addition to the above bracket. When the roller of any one of the sort bins 133 is received in the groove of the lead cam 136, the cam 136 is rotated to move the bin 133 upward or downward. This kind of configuration of the mechanism 134 is conventional.

The conveyor 135 includes a conveyor body 137, a drive roller 138, a driven roller 139, a plurality of parallel endless belts 140 passed over the drive roller 138 and driven roller 139, and a suction fan 141 positioned below the belts 140. Opposite edges of a top plate, not shown, forming part of the conveyor body 137 are bent upward at the downstream end in the direction of paper conveyance, forming jump lugs 142. A sort jam sensor 143 senses a jam when the paper P driven out of the printer 1 fails to reach any one of the bins 133 within a preselected period of time. A sort position sensor 144 senses the position of the bin 133 in terms of the amount of rotation of the lead cam 136.

The operation of the printer 1 with the sorter 131 is as follows. When the main power supply of the printer 1 is turned on, the printer 1 executes the previously stated sequence of steps and waits in the stand-by state ready to make a master, as in the previous embodiment. At the same time, the control mans 124 sends a signal to the sorter 131 to cause the lead cam 136 to rotate. In response to an output of the sort position sensor 144, the uppermost bin or non-sort tray 133 is brought to a position where it faces the conveyor 135. If the sort jam sensor 143 is in an ON state, then a message representative of a jam appears on the operation panel 104.

The printer 1 and sorter 131 can be used only if the printer 1 is in its stand-by state, if the uppermost bin 133 is located at the above posit ion, and if the sort jam sensor 143 is in its OFF state.

Subsequently, when the operator lays a document on the document feed tray 11 and then presses the perforation start key 105, the printer 1 performs the image reading operation, master discharging operation, master making operation, master wrapping operation and trial printing operation and then waits for an actual printing operation, as in the previous embodiment.

Assume that the operator selects the sorter 131 on a suitable key provided on the control panel 104, e.g., the mode key 113 and then presses the print start key 106. In response, the papers P are sequentially fed from the paper feeding section 3 while the lead cam 136 is rotated to sort the resulting printings P in accordance with a desired number of copies (sets).

After the papers P have been sorted by the sorter 131, the operator presses the power save mode key 122. In response, the previously stated data are written to the RAM 126 while power supply to all of the constituents other than the power save mode indicating means 123 is interrupted in order to save power. In the illustrative embodiment, bin position data output from the sort position sensor 144 is written to the RAM 126 in addition to the above data.

When the operator selected the power save mode again presses the power save mode key 122 for canceling it, a signal output from the key 122 is sent to the CPU 125 included in the control means 124. In response, the CPU 125 delivers an output OFF signal to the output OFF device 130. In response, the output OFF device 130 again supplied power to all of the constituents, so that all the outputs of the printer land sorter 131 are turned on. At this time, the CPU 125 reads the data written to the RAM 126 at the beginning of the power save mode and compares them with current data output at the time of recovery from the power same mode.

If the stored data and current data compare equal, CPU 125 directly brings the printer 1 and sorter 131 into their ready states, skipping the steps to be executed at the time of turn-on of the main power supply. If any one of the recovered data differs from corresponding one of the stored data, the CPU 125 brings the printer 1 or the sorter 131 to the stand-by state after causing only a portion relating to the different data to operate or after varying the display.

As stated above, when the printer 1 and sorter 131 are not used, the power save mode is set up to obviate wasteful power consumption. In addition, at the time of cancellation of the power save mode, the printer 1 and sorter 131 skip needless steps for thereby preventing the first print time from being delayed.

The modifications of the previous embodiment are also applicable to the above alternative embodiment. Further, the power save mode may be cancelled in response to a signal output from the sorter 131. If desired, a personal computer may be connected to the printer 1, in which case the power save mode will be cancelled in response to a signal received from the personal computer.

In the embodiments shown and described, among the four different voltages of +24 V, ±12 V, +5 V and +5 VE, only the voltage of +5 V is continuously applied to the control means 124 and power save mode indicating means 123. If desired, the voltage of +5 V may be connected to necessary sensors in the same manner as to the sensors 102 and 103 from the convenient operation standpoint. In addition, voltages of +24 VE and ±12 VE may be used in addition to the voltages of +24 V and ±12 V, so that any desired unit can operate even in the power save mode.

In summary, it will be seen that the present invention provides a stencil printer capable of being held in a power save mode for saving power when it is not used. In addition, the printer can recover from the power save mode without any wasteful step so as to prevent the first print time from being delayed.

Various modifications will become possible for those skilled in the art after receiving the teachings of the present disclosure without departing from the scope thereof.

What is claimed is:

1. A stencil printer for printing an image on a recording medium with a master wrapped around an ink drum and having a power save mode for saving power when said stencil printer is not used, said stencil printer comprising:

storing means for storing conditions of said stencil printer when said power save mode is selected; and comparing means for comparing, when said power save mode is cancelled, the condition stored in said storing means and current conditions of said stencil printer;

wherein said conditions comprise at least one of a master making condition, a used master discharging condition, an ink drum condition and a compressor condition.

2. A stencil printer as claimed in claim 1, further comprising inhibiting means for inhibiting said power save mode from being selected in at least one of a condition wherein said stencil printer is in operation, a condition wherein a serviceman call is output, a condition wherein a jam is displayed, and a condition wherein the master is absent on said ink drum.

3. A stencil printer as claimed in claim 1, wherein the at least one condition comprises at least one condition from the group consisting of a position of a leading edge of a master, a position of an ink drum, and a position of a compressor for compressing a used master removed from an ink drum.

4. A stencil printer as claimed in claim 3, further comprising inhibiting means for inhibiting said power save mode from being selected in at least one of a condition wherein said stencil printer is in operation, a condition wherein a serviceman call is output, a condition wherein a jam is displayed, and a condition wherein the master is absent on said ink drum.

5. A stencil printer for printing an image on a recording medium with a master wrapped around an ink drum, and having a power save mode for saving power when said stencil printer is not used, and allowing a peripheral unit to be operatively connected to said stencil printer, said stencil printer comprising:

storing means for storing conditions of said stencil printer and conditions of said peripheral unit when said power save mode is selected; and comparing means for comparing, when said power save mode is cancelled, the conditions stored in said storing means and current conditions;

wherein said conditions comprise at least one of a master making condition, a used master discharging condition, an ink drum condition and a compressor condition.

6. A stencil printer as claimed in claim 5, further comprising inhibiting means for inhibiting said power save mode from being selected in at least one of a condition wherein said stencil printer is in operation, a condition wherein a serviceman call is output, a condition wherein a jam is displayed, and a condition wherein the master is absent on said ink drum.

7. A stencil printer as claimed in claim 5, wherein the at least one condition comprises at least one condition from the group consisting of a position of a leading edge of a master, a position of an ink drum, and a position of a compressor for compressing a used master removed from an ink drum.

8. A stencil printer as claimed in claim 7, further comprising inhibiting means for inhibiting said power save mode from being selected in at least one of a condition wherein said stencil printer is in operation, a condition wherein a serviceman call is output, a condition wherein a jam is displayed, and a condition wherein the master is absent on said ink drum.

9. A stencil printer including an image reading section, a master making section, a master discharging section, a printing section, and a recording medium discharging section for printing an image on a recording medium with a master wrapped around an ink drum said stencil printer comprising:

power save mode setting means for setting a power save mode for saving power when said stencil printer is not used;

storing means for storing a condition of at least one of said sections when said power save mode is selected; and comparing means for comparing, when said power save mode is cancelled, the condition of the at least one section;

wherein when the condition stored in said storing means and the current condition compare equal, said stencil printer is brought to a stand-by state; and wherein said conditions comprise at least one of a condition of a master making section, a condition of a used master discharging section, a condition of an ink drum section, and a condition of a compressor section.

10. A printing method for causing a stencil printer to print an image on a recording medium with a master wrapped around an ink drum, and including a power save mode for saving power when said stencil printer is not used, said printing method comprising the steps of:

storing conditions of said stencil printer when said power save mode is selected; and comparing, when said power save mode is cancelled, the conditions stored and current conditions;

wherein said conditions comprise at least one of a master making condition, a used master discharging condition, an ink drum condition and a compressor condition.

11. A printing method for causing a stencil printer to print an image on a recording medium with a master wrapped around an ink drum, and including a power save mode for saving power when said stencil printer is not used, and allowing a peripheral unit to be operatively connected to said stencil printer, said printing method storing conditions of said stencil printer and conditions of said peripheral unit when said power save mode is selected; and comparing, when said power save mode is cancelled, the conditions stored and current conditions;

wherein said conditions comprise at least one of a master making condition, a used master discharging condition, an ink drum condition and a compressor condition.

12. A printing method for causing a stencil printer including a master section, a master discharging section, an ink drum section and a compressor section to print an image on a recording medium with a master wrapped around an ink drum, said printing method comprising the steps of:

setting a power save mode for saving power when said stencil printer is not used;

storing a condition of at least one of said sections when said power save mode is selected; and comparing, when said power save mode is cancelled, the conditions stored and current conditions of the at least one section;

wherein when the conditions stored and the current conditions compare equal, said stencil printer is brought to a stand-by state.

* * * * *

UNITED STATES PATENT AND TRADEMARK OFFICE

CERTIFICATE OF CORRECTION

PATENT NO. : 6,334,719 B1
DATED : January 1, 2002
INVENTOR(S) : Hitoshi Kimura

It is certified that error appears in the above-identified patent and that said Letters Patent is hereby corrected as shown below:

Column 4,
Lines 50 and 54, change "damper" to -- clamper --;
Line 58, change "droller" to -- roller --;

Column 9,
Lines 22, 35, 37 and 39, change "damper" to -- clamper --;

Column 13,
Line 18, change "posit ion" to -- position --;
Line 49, change "1and" to -- 1 and --; and
Line 52, change "same" to -- save --.

Signed and Sealed this

Twenty-eighth Day of May, 2002

*Attest:*

*Attesting Officer*

JAMES E. ROGAN
*Director of the United States Patent and Trademark Office*